United States Patent [19]

Kraft et al.

[11] Patent Number: 4,560,441

[45] Date of Patent: Dec. 24, 1985

[54] PRESS SECTION FOR A PAPER-MAKING MACHINE HAVING A MOVABLE CANTILEVER BEAM

[75] Inventors: Wilfred Kraft; Wilhelm Benz, both of Heidenheim, Fed. Rep. of Germany

[73] Assignee: J. M. Voith GmbH, Fed. Rep. of Germany

[21] Appl. No.: 435,484

[22] Filed: Oct. 20, 1982

Related U.S. Application Data

[63] Continuation-in-part of Ser. No. 386,645, Jun. 9, 1982, abandoned, which is a continuation of Ser. No. 200,477, Oct. 24, 1980, abandoned.

[30] Foreign Application Priority Data

Oct. 3, 1979 [DE] Fed. Rep. of Germany ..... 2943974

[51] Int. Cl.[4] ..... D21F 3/02; D21F 3/04

[52] U.S. Cl. ..... 162/273; 162/358

[58] Field of Search ..... 162/200, 273, 274, 350; 100/160, 168

[56] References Cited

U.S. PATENT DOCUMENTS

| | | | |
|---|---|---|---|
| 2,870,691 | 1/1959 | Wisner | 162/273 |
| 3,989,587 | 11/1976 | Grussman | 162/200 |
| 4,140,575 | 2/1979 | Wenzel . | |
| 4,220,501 | 9/1980 | Skauyen | 162/200 |

FOREIGN PATENT DOCUMENTS

| | | | |
|---|---|---|---|
| 2239267 | 8/1972 | Fed. Rep. of Germany . | |
| 2062042 | 5/1981 | United Kingdom | 162/273 |

OTHER PUBLICATIONS

Pressenpartien in Vollcantileverbauart fur Pick up-Filz und dritten Pressfilz.

*Primary Examiner*—Steve Alvo

*Attorney, Agent, or Firm*—Ostrolenk, Faber, Gerb & Soffen

[57] ABSTRACT

A press section of a cantilever beam type paper-making machine is disclosed. The machine includes press rollers and guiding rollers for supporting an endless loop felt. The press section of the machine includes an operating side frame component and a power side frame component separated therefrom. A structural part is located beyond the power side outside the press section. A cantilever beam extends from the operating side frame component past the power side frame component to the structural part. Intermediate supporting pieces normally support the operating side frame component on the base of the machine. To install a new felt the intermediate part must be removed. A hydraulic piston-cylinder combination presses upon the cantilever beam to bow it for lifting the operating side frame component off the intermediate part sufficiently to free the intermediate part for removal. After installation of the felt, the intermediate parts are reinstalled and the bias on the cantilever beam is removed, reinstalling the operating side frame component on the intermediate piece. The piston-cylinder combination, as appropriate, may be located at the operating side frame component, the power side frame component or the structural part in various embodiments.

24 Claims, 5 Drawing Figures

PRESS SECTION FOR A PAPER-MAKING MACHINE HAVING A MOVABLE CANTILEVER BEAM

CROSS-REFERENCE TO RELATED APPLICATIONS

This is a continuation-in-part of application Ser. No. 386,645, filed June 9, 1982, now abandoned, which is a continuation of application Ser. No. 200,477, filed Oct. 24, 1980, now abandoned.

BACKGROUND OF THE INVENTION

The invention relates to a press section for a paper-making machine in which a continuous felt web, called a felt, carries a web of paper that is to be dewatered through a nip defined between two press rolls. The continuous felt must be periodically replaced.

It is known to provide the press section with what is called a cantilever beam to facilitate mounting a new felt. One example of a cantilevered press section is shown in U.S. Pat. No. 3,547,776. One of the press rolls, in this case the lower roll, is inside the continuous loop of the felt. The press roll rests on a component of the drier frame that is located on the operating side of the machine, i.e. the side having the machine controls on it, and also on another drier-frame component on the power side, where the drive connections to the rolls may be found. Two cantilever beams extend from the operating-side component to the power-side component and from there to a connection outside the press section. This connection is usually a structural element, although it is not mentioned in the above U.S. patent. When this paper-making machine is ready to operate, the drier-frame component on the operating side rests, through removable intermediate pieces, on one of the bases of the machine. The power-side component also rests on one of the machine bases, although its supports cannot be removed.

As a preliminary to mounting a new felt, the drier-frame component on the operating side of the machine must be slightly lifted to remove the intermediate pieces. One or two pneumatically or hydraulically operated piston cylinder combinations, spring or the like type lifting devices, or other force generators are usually positioned between the machine base and the operating-side component to lift the latter. Once the operating side component has been lifted and the intermediate pieces removed, the piston cylinders must be evacuated, leaving the operating-side drier-frame component supported only by the cantilever beams. In this state, the new felt can be introduced into the press section. The operating-side ends of the cantilever beams tend to sag under the weight of the drier-frame component and the press roll resting on it, so that the operating-side drier-frame component will drop. Since the cantilever beam is rigidly attached to the operating-side drier-frame component, that frame component will assume a skewed position as the cantilever beam deforms. This puts a lot of stress on the bearings that support the press roll because the distance between the operating-side and power-side bearings of each roll, which is resting on the operating-side component of the drier frame, increases. This leads to the risk of an excessive axial force in the roll bearings.

The above noted design has other drawbacks. The severe deformation of the cantilever beams generates powerful forces in threaded connections, especially in the connections between the beams and the operating-side drier frame components. Several time-consuming operations are necessary to insert a new felt. The operating-side component must be lifted, the intermediate pieces removed, the component released, the new felt inserted, the component lifted again, the intermediate pieces replaced, and the component supported on them again.

Another known system of mounting a new felt, described in German OS No. 2,239,267, required fewer operations. The essential characteristics of this known design include a cantilever beam that is non-rigidly attached to the power side drier-frame component by an articulated joint. The end of the cantilever beam outside the press section is connected to the supporting structure by a drawbar. The operating-side end of the beam supports a bearing housing for a press roll and is connected with the machine frame through a removable intermediate piece, which pivots around a vertical axis. A continuous felt and a continuous plastic wire screen, called a wire, travel over the press roll, which in this case is an upper roll.

The only step preliminary to mounting a new plastic wire is to draw down the end of the cantilever beam that is outside the press section with a tensioning device or force generator and only until the operating-side end drier frame component releases the intermediate piece supporting it. The intermediate piece on the operating-side end of the cantilever beam is then removed, the wire is introduced, and the original state is rapidly restored. One drawback to this known design, however, is that the operating-side drier-frame component which is in this case one of the press-roll bearing housings, is rigidly connected to the cantilever beam. Since the cantilever beam is in principle deformed in exactly the same way as in the first mentioned example, the bearing housing will also assume a skewed position, as will the leading-roll bearing housings when mounted on the cantilever beam.

There are also other considerations. Only one of these belts, the plastic wire, is easy to introduce into the press section, in the form of an open loop. In contrast, the felt can be mounted in this way only over the press roll and some of the felt-leading or other felt supporting rolls. To install the felt into its final position, it has to be folded or pleated, because in its final position, it loops around other felt-leading rolls that are supported on longitudinal beams at the top of the press section. Many contemporary felts, however, are too thick to be thus folded or pleated. Also, the folding or pleating cannot be done in the wider paper-making machines. One makeshift approach is to remove the felt-leading or supporting rolls, mount the loop of felt, and remount the rolls inside the felt loop. This method takes a lot of time and is extremely difficult in wide machines.

SUMMARY OF THE INVENTION

The present invention is intended to eliminate the drawbacks of the designs described above. According to the invention, the drier-frame component on the operating side will remain essentially in the same position as when the machine is ready to operate while that component is supported only by the cantilever beam. The component will not lie askew in any case. Even though it is very long, the continuous felt can also be introduced in the form of an open loop, i.e. without being folded or pleated, into the press section even when some of the felt-leading rolls rest on the upper surfaces of elevated longitudinal beams.

A system of force generators, like that known from German OS No. 2,239,267, is utilized in the present invention. The force generators engage the cantilever beam and bring it into a "state of tension" so that its operating-side end will exercise an upward force on the operating-side drier frame component to compensate for the inherent weight of that component and the structures attached to it.

The present invention, however, also deviates substantially from the device specified in the above Offenlegungsschrift. First, not only the drier-frame component on the power side of the machine but also that drier-frame component on the operating side can move in relation to the cantilever beam. Second, the operating side drier-frame component is connected to the drier frame component on the power side by at least one additional transverse beam that is preferably rigidly connected to both those drier-frame components. This means that when the cantilever beam is in a state of tension, the operating-side component will largely retain its position in relation to the power-side component, no matter how much the cantilever beam deforms. The only preliminary step to changing a felt is to lift the drier-frame component on the operating side very slightly (about 1–2 mm) while it is subject to the force of the tensioned cantilever beam. This position is maintained after the intermediate pieces have been removed and while the felt is being introduced. There is absolutely no skewing of the operating-side drier-frame components. Even when a very long felt is employed, it now becomes possible to support all the leading or felt supporting rolls inside the loop of felt on the operating-side drier-frame component or on an extension of it, such as a roll bearer oriented upward. The operating-side drier-frame component, including the extension, if any, is often as a whole an extremely complex structure, which usually has to be supported at two or three points with intermediate removable pieces on machine-framework structures below it. The intermediate pieces used with the invention can all be removed simultaneously to permit introduction of the continuous felt in the form of an open loop into the paper-making machine, even a felt that is very long. Since this saves considerable time, paper manufacture needs to be interrupted only briefly to change the felt.

Another deviation from OS No. 2,239,267 is that no roll is directly supported by the cantilever beam. The bearings for all the rolls are instead attached to the drier-frame components. Another significant characteristic of the invention is that the tensioned cantilever beam can be allowed to sag a lot more than the cantilever beam in the known designs because deformation of the beam can occur completely independent of the drier-frame components and rolls. This enables that cantilever beam to be thinner and hence easier and cheaper to manufacture. In calculating the cross-sectional dimensions of the cantilever beam, in other words, it is only necessary to consider material's strength, while the degree of deformation of the beam in the state of tension can be ignored. In previous designs, on the other hand, the beam must be as rigid and hence as heavy as possible to keep it from sagging as much as possible when it is tensioned.

BRIEF DESCRIPTION OF THE DRAWINGS

Some embodiments of the invention will now be described with reference to the accompanying drawings, in which.

DESCRIPTION OF PREFERRED EMBODIMENTS OF THE INVENTION

Figure 1:
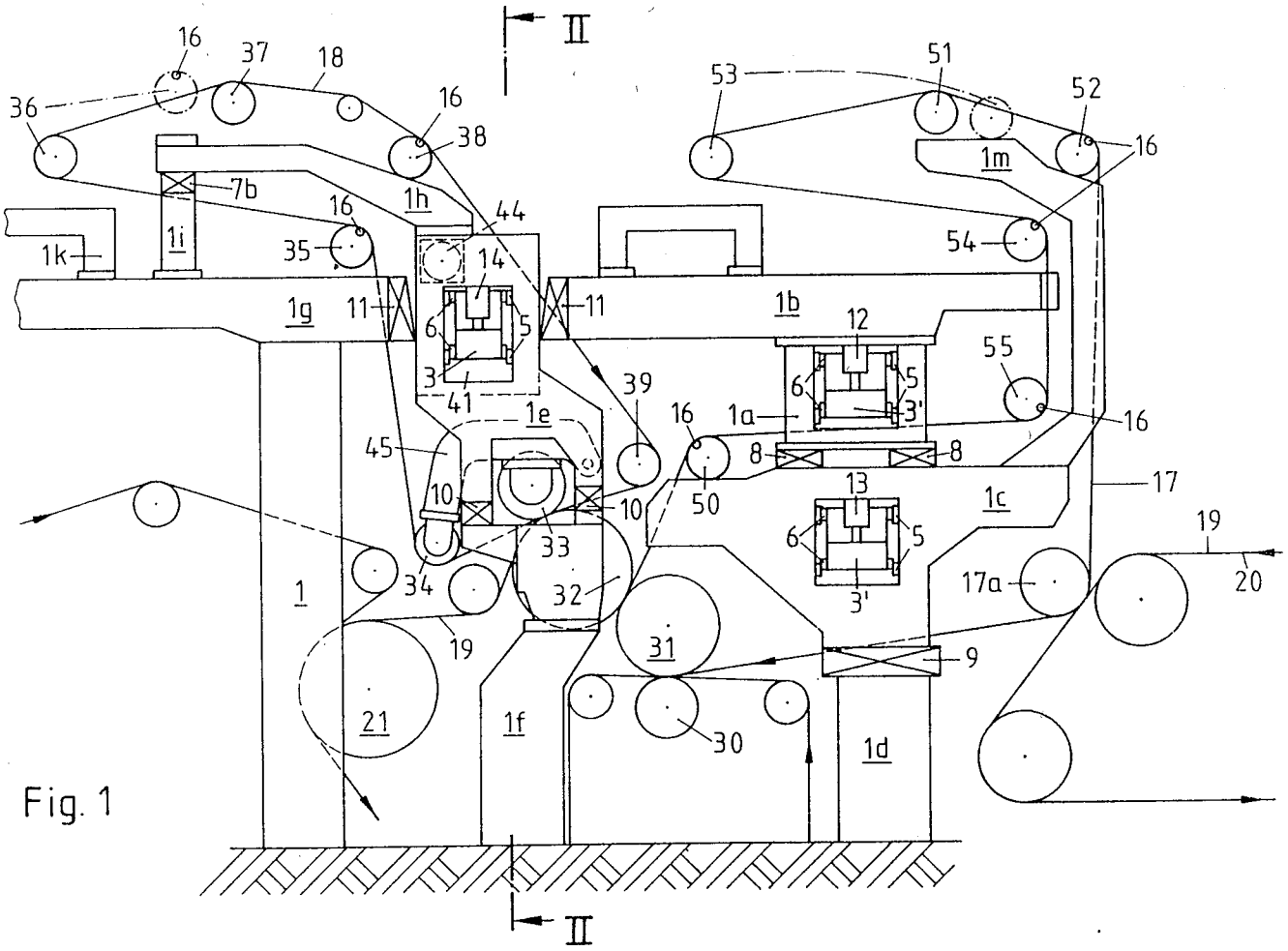
FIG. 1 is a schematic side view of the press section of a paper-making machine.

FIG. 1 shows a press section employed to dewater a paper web. Web 19 to be dewatered arrives from a wire section 20. The web is removed from the wire by a felt 17 and by a suction roll 17*a* and is then fed through three roll nips, formed by the press rolls 30, 31 and 31, 32, and 32, 33, in succession. Web 19 is then supplied to the subsequent dry section, of which only the first drying cylinder 21 is illustrated in FIG. 1. As web 19 leaves the second nip formed by rolls 31, 32 along with felt 17, it separates from felt 17 and is carried along alone by the surface of roll 32 into the third nip formed by rolls 32, 33. Another dewatering felt 18 also runs through the third nip. The guide rollers 34 through 39 guide the felt 18.

The design of the press section will now be specified, initially through the example of those frame components that are necessary for rolls 32 through 39.

Figure 2:
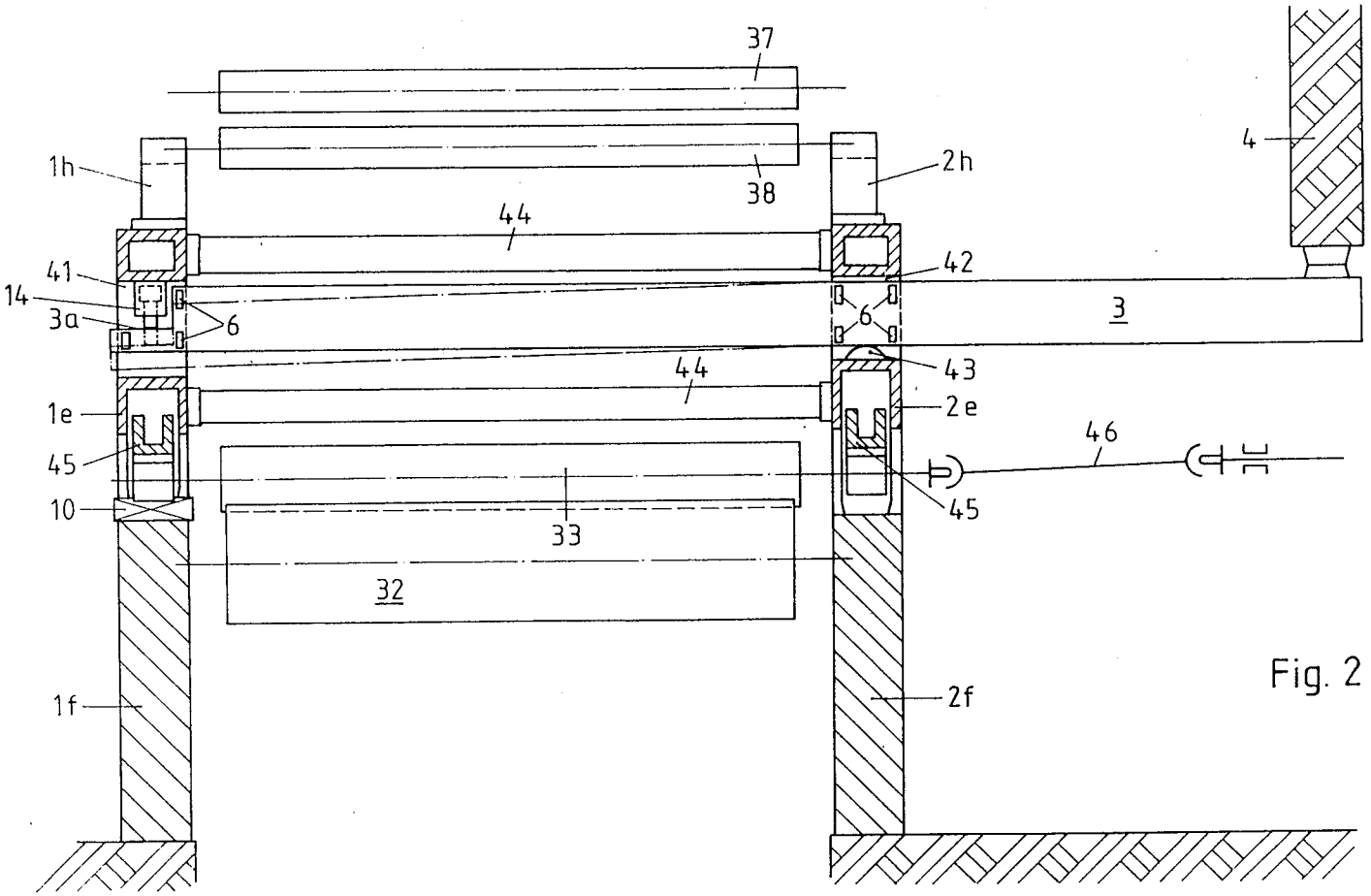
FIG. 2 is a cross-sectional view through the press section along line II—II in FIG. 1, and FIGS. 3 through 5 are schematic representations, viewed as in FIG. 2, showing various methods of tensioning the cantilever beam.

FIGS. 1 and 2 show how the press roll 32 is mounted in an operating-side structure 1*f* and a power-side structure 2*f* of the press section of a paper-making machine. Two drier-frame components, 1*e* and 2*e* for press roll 33 and for leading or felt guiding rolls 34, 37, 38 and 39, rest on structures 1*f* and 2*f*. Installation of the felt loop 18 from the operating-side is blocked by the unbroken structure extending from the rolls 33–39 to the support base 1 and 1*f*.

To enable installation and removal of the felt 18, removable intermediate pieces 10 are provided between operating-side drier-frame component 1*e* and structure 1*f*. On the other hand, power-side drier-frame component 2*e* rests directly on structure 2*f* without intermediate pieces between them. Two mainly horizontally extending roll bearers 1*h* and 2*h* are attached to the upper surface of each drier-frame component 1*e* and 2*e*, respectively, to support rolls 37 and 38. On the operating side, the outer end of roll bearer 1*h* rests through a removable intermediate piece 7*b* on a structure 1*i* that stands on an elevated longitudinal beam 1*g*. Beam 1*g* rests on a large machine framework 1. Felt leading roll 35 and an associated structure 1*k* are also mounted on the longitudinal beam 1*g*. Between operating-side drier-frame component 1*e* and each of the longitudinal beam 1*g* and another longitudinal beam 1*b* on opposite sides of the component 1*e*, there is another respective removable intermediate piece 11.

Drier-frame components 1*e* and 2*e* have window-like holes 41 and 42, respectively, through them which receive a cantilever beam 3. Cantilever beam 3 extends conventionally from operating-side drier-frame component 1*e* to power-side drier-frame component 2*e* and thence through the press section to a support 4 that is an integral part of the framework. As viewed in section (FIG. 2), cantilever beam 3 is supported at only two points, on an articulated base 43 in the hole 42 in power-side drier-frame component 2*e* and at support 4.

Cantilever beam 3 has sliding-guide plates 6 in the vicinity of holes 41 and 42 to guide it laterally. Plates 6 are in contact with cooperating guide surface 5 on drier-frame components 1*e* and 2*e*.

Since there is no secured connection between cantilever beam 3 and operating-side drier-frame component 1*e*, aside from vertical sliding guides 5 and 6, drier-frame components 1*e* and 2*e* are rigidly attached together by at least one additional transverse beam 44 that is nonshiftably secured to the components 1*e* and 2*e*. FIG. 1 shows such an additional transverse beam 44 with broken lines. Another transverse beam of the same kind can be mounted at the free end of roll bearer 1*h*.

A recess 3*a* extends down into and partially across the operating-side end of the cantilever beam 3 to accommodate a hydraulic piston-cylinder combination 14 between cantilever beam 3 and drier-frame component 1*e*. The piston in cylinder 14 can bend the free, operating-side end of cantilever beam 3 downwardly, as illustrated by the dot-and-dash line in FIG. 2. The cylinder combination 14 on component 1*e* simultaneously exerts an upward force on operating-side drier-frame component 1*e*. This force is just strong enough to lift the operating-side drier-frame component 1*e* very slightly off intermediate pieces 10 so that they can be removed. Operating-side drier-frame components 1*e* and 1*h* must be lifted slightly to allow a new felt 18 to be introduced. This process will be explained in detail below.

Press roll 33 is mounted on pivotable arms 45, which are located at components 1*e* and 2*e*. The press roll 33 is driven by a Cardan shaft 46. Felt-leading roll 34 is also attached to the arms 45. This system allows rolls 33 and 34 to be lifted together when a new felt is introduced.

To change a felt, it is necessary to lift operating side drier-frame component 1*e* and pivoting arm 45, to then remove intermediate pieces 7*b*, 10 and 11 on the operating side and to thereafter shift leading roll 36 into the position indicated by the dot-and-dash line, onto roll bearers 1*h* and 2*h*.

The spaces now available due to removal of the intermediate pieces permit introduction of a fresh continuous loop felt 18 into the press section. The felt is supported in the vicinity of the operating side of the press section in the form of an open loop and is introduced from left to right, as seen in FIG. 2. Horizontal rods 16 (illustrated in FIG. 1, but not in FIG. 2) can be mounted on the outside of operating-side drier-frame components 1*e* and 1*h* or on operating side catwalks (not shown) to facilitate introduction of the felt. The sections of catwalk that must be shifted when changing the felts should fold away to save time.

If it is desired to release the hydraulic cylinder combination 14 during the course of the felt-changing process, additional intermediate pieces (not illustrated) can be inserted between the operating-side drier-frame component 1*e* after it has been lifted and the operating-side end of the cantilever beam. This is a preventive measure and derives from the impossibility of ruling out cylinder failure.

Another fresh felt 17, which follows a generally C-shaped pathway, can also be introduced into the other part of the press section by using the same method in principle. The design of the respective drier-frame components for this felt, however, differs in detail to some extent from that described above. There is an operating-side drier-frame component 1*c* that rests through a removable intermediate piece 9 on a base structure 1*d*. The component 1*c* supports a roll bearer 1*m*. Roll bearer 1*m* has generally a C-shaped opening, to the left in FIG. 1, and toward below-described component 1*a* and beam 1*b*. Rolls 17*a*, 31, 50, 51 and 52 are mounted on drier-frame component 1*c* and roll bearer 1*m*. As shown in dash-dot line, roll 53 is also shifted to the roll bearer 1*m* while the felt is being changed.

Another drier-frame component 1*a* also rests through removable intermediate pieces 8 on drier-frame component 1*c*. Longitudinal beam 1*b*, mentioned above, rests on component 1*a*. Leading or felt supporting rolls 53, 54 and 55 are mounted on drier-frame components 1*a* and 1*b* and thus not on the roll bearer 1*m*. The felt 17 is wrapped around all of the felt guiding rolls on component 1*c* and roll bearer 1*m*, and these rolls are placed to bend the felt 17 into the generally C-shaped pathway shown.

Drier-frame components 1*a* and 1*c* have window-like openings like those in drier-frame component 1*e*, with a cantilever beam 3' extending into each. Beams 3' are designed essentially like beam 3, which is described in detail above. Hydraulic piston cylinder combinations 12 and 13 on drier-frame components 1*a* and 1*c*, respectively, have the same function as hydraulic piston cylinder combination 14.

To introduce a fresh felt 17, drier-frame components 1*a* and 1*b* are lifted, intermediate pieces 8 are removed, drier-frame components 1*c* and 1*m* are lifted, and intermediate piece 9 is removed. Rolls 17*a* and 31, which are mounted on pivoting arms, still have to be lifted first and roll 53 has to be shifted to roll bearer 1*m*.

Figure 3:
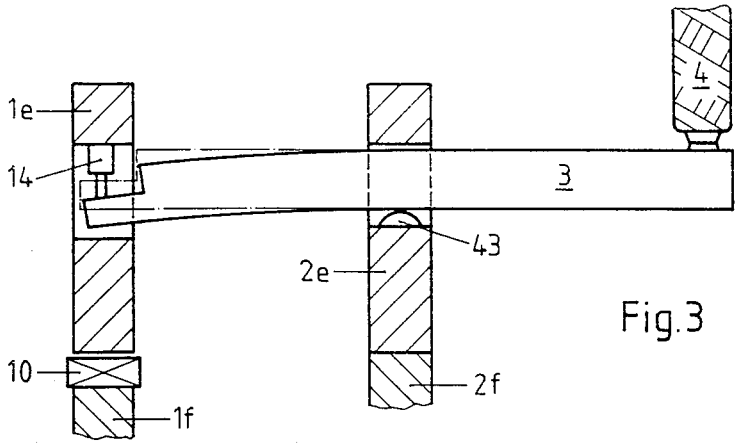
Figure 4:
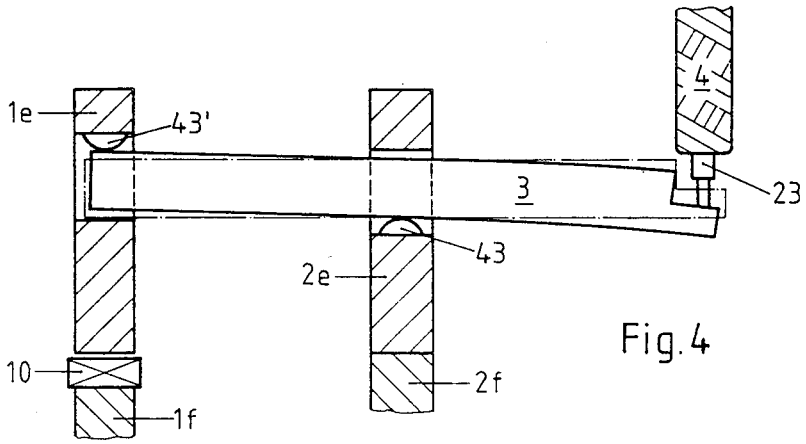
Figure 5:
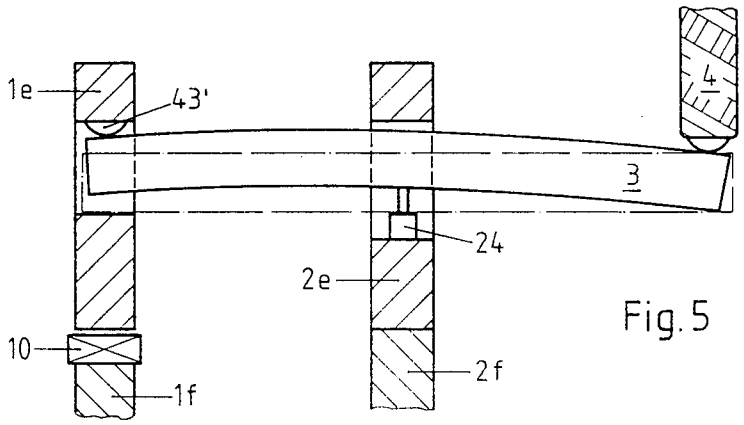

FIGS. 3–5 are schematic illustrations of different methods of tensioning cantilever beams 3 or 3'. All rolls and transverse beam 44 have been omitted from these Figures.

FIG. 3 illustrates the method used with the embodiment in FIG. 2, which was described above, in which the operating-side end of cantilever beam 3 is forced down.

FIG. 4 shows a second embodiment with a hydraulic piston cylinder combination 23 on support 4. When the cylinder is charged, the end of cantilever beam 3 that is positioned at that point is bent down. Since there is another articulated support point 43 in power-side drier frame 2, cantilver beam 3 forces operating-side drier-frame component 1*e* up through still another articulated support point 43'.

FIG. 5 shows a third embodiment with a hydraulic piston cylinder 24 in power-side drier-frame 2. That can bend up the section of the cantilever beam 3 that is positioned at that point. This will again force operating-side drier-frame component 1*e* up.

Although the present invention has been described in connection with preferred embodiments thereof, many variations and modifications will now become apparent to those skilled in the art. It is preferred, therefore, that the scope of the invention be limited not by the specific disclosure herein, but only by the appended claims.

What is claimed is:

1. A press section for a paper-making machine, wherein the press section includes press rollers for squeezing a felt, and felt guiding rollers for leading the felt over a pathway and past the press rollers;

a base of the machine for supporting the press section;

an operating side frame component located toward one of the ends of the press rollers; a power side frame component located toward the other of the ends of the press rollers and spaced from the operating side frame component;

a cantilever beam extending from the operating side frame component to the power side frame component and beyond the power side frame component to a support area;

a structural part connected to the base of the machine and located in the support area; the cantilever beam extending to the structural part, for defining three points of contact along the length of the cantilever beam, at the structural part, at the power side frame component and at the operating side frame component; the cantilever beam meeting both the operating side frame component and the power side frame component at respective points of contact, the cantilever beam being movable relative to each of the frame components at the respective point of contact;

an intermediate piece removably disposed between the operating side frame component and the base of the machine for supporting the operating side frame component, and the operating side frame component rests on the intermediate piece;

force applying means for applying force to the cantilever beam for tensioning the cantilever beam for lifting the operating side frame component off the intermediate piece, which permits removal of the intermediate piece; and an additional transverse beam spaced away from the cantilever beam for connecting the operating side frame component and the power side frame component.

2. The press section of claim 1, wherein the intermediate piece is located where it normally blocks installation of a felt on the press rollers and on the guiding rollers, through movement of the felt past the operating side frame component, whereby removal of the intermediate piece enables installation of the felt on the press rollers and the guide rollers.

3. The press section of claim 1, wherein the force applying means is provided at the operating side frame component for pressing the cantilever beam downward with respect to the press rollers and with respect to the operating side frame component for urging the operating side frame component upward; the cantilever beam engages the power side frame component in a manner such that the power side frame component resists downward movement of the cantilever beam with respect to the power side frame component; and the cantilever beam engages the structural part in a manner such that the structural part resists upward movement of the cantilever beam with respect to the structural part.

4. The press section of claim 1, wherein the force applying means is provided at the structural part for pressing the cantilever beam downward with respect to the press rollers and with respect to the structural part; the cantilever beam engages the power side frame component in a manner such that the power side frame component resists downward movement of the cantilever beam with respect to the press rollers and with respect to the power side frame component; and the cantilever beam engages the operating side frame component for urging the operating side frame component upward as the cantilever beam is pressed downwardly by the force applying means.

5. The press section of claim 1, wherein the force applying means is provided at the power side frame component for pressing the cantilever beam upward with respect to the power side frame component and with respect to the press rollers; the cantilever beam engages the structural part in a manner such that the structural part resists upward movement of the cantilever beam with respect to the structural part; and the cantilever beam engages the operating side frame component for urging the operating side frame component upward with respect to the press rollers.

6. The press section of claim 1, wherein the force applying means is for acting on the cantilever beam for causing the section of the cantilever beam at the power side frame component to bow upwardly relative to the sections of the cantilever beam at both the operating side frame component and the structural part and for causing the beam to apply force to the operating side frame component for raising the operating side frame component to free the intermediate piece for removal.

7. The press section of claim 1, wherein the force applying means applies downward pressure to the cantilever beam with respect to the press rollers, and the downward pressure is applied by the pressure means at one of the operating side frame component and the structural part.

8. The press section of claim 7, wherein the force applying means applies downward pressure to the cantilever beam at the operating side frame component and at the same time applies upward pressure to the operating side frame component for raising the operating side frame component to free the intermediate piece for removal.

9. The press section of claim 1, wherein the operating side frame component includes a vertical movement slideway in which the cantilever beam is received, such that the cantilever beam may be moved along and in the slideway by the force applying means.

10. The press section of claim 9, wherein the slideway comprises a window-like opening in the operating side frame component through which the cantilever beam extends, and further comprises slide guides positioned on both sides of the cantilever beam in the vicinity of the window-like opening.

11. The press section of claim 9, wherein the power side frame component includes a second vertical movement slideway in which the cantilever beam is received, such that the cantilever beam may be moved along and in the second slideway by the force applying means.

12. The press section as claimed in claim 11, wherein the slideway in the operating side frame component and the second slideway in the power side frame component each comprises a respective window-like opening in the respective frame component through which the cantilever beam extends.

13. The press section of claim 1, wherein the power side frame component includes a vertical movement slideway therein in which the cantilever beam is received, such that the cantilever beam may be moved along and in the slideway by the force applying means.

14. The press section of claim 1, wherein the force applying means comprises a hydraulically operated device for acting upon the cantilever beam.

15. The press section of claim 1, further comprising a roll-bearer on the operating side frame component for supporting at least some of the felt guiding rollers.

16. The press section of claim 15, wherein the roll bearer seats on the operating side frame component and also extends a distance from the operating side frame component, and the roll bearer thereby also extending over the base of the machine; the roll bearer being shaped and positioned for supporting the felt guiding rollers;

a second intermediate piece disposed between the roll bearer and the machine base for supporting the roll bearer above the base; and the roll bearer being raised along with the operating side frame component on which the roll bearer sits, off the second intermediate piece to free the second intermediate piece for removal.

17. The press section of claim 15, further comprising a second one of the operating side frame components which is separate from the first-mentioned operating side frame component;

a second one of the roll bearers supported on the second operating side frame components; a plurality of second felt guiding rollers for guiding a second felt, and the second guiding rollers being supportable on the second roll bearer;

a second removable intermediate piece being interposed between the second operating side frame component and the base;

a second one of the cantilever beams for engaging and raising the second operating side frame component to enable removal of the second intermediate piece and second force applying means for applying pressure to the second cantilever beam.

18. The press section of claim 17, further comprising a third operating side frame component; the second operating side frame component being disposed between the third operating side frame component and the base; and a third cantilever beam for raising the third operating side frame component off the second operating side frame component.

19. The press section of claim 15, further comprising a second one of the operating side frame components, which is separate from the first-mentioned operating side frame component; the first operating side frame component being disposed between the second operating side frame component and the base; some of the felt guiding rollers being supported on the second operating side component;

a second removable intermediate piece being interposed between the second operating side frame component and the first operating side frame component;

a second one of the cantilever beams for engaging and raising the second operating side frame component to enable removal of the second intermediate piece, and second force applying means for applying pressure to the second cantilever beam.

20. The press section of claim 19, wherein the roll bearer is generally C-shaped, with the open side of the C-shape facing toward and accommodating the second operating side frame component.

21. The press section of claim 1, further comprising an endless loop felt for normally passing between the press rollers and for passing over the guide rollers for being guided for movement past the press rollers.

22. A press section for a paper-making machine, wherein the press section includes press rollers for squeezing a felt, and felt guiding rollers for leading the felt over a pathway and past the press rollers;

a base of the machine for supporting the press section;

an operating side frame component located toward one of the ends of the press rollers; a power side frame component located toward the other of the ends of the press rollers and spaced from the operating side frame component;

a cantilever beam extending from the operating side frame component to the power side frame component and beyond the power side frame component to a support area;

a structural part connected to the base of the machine and located in the support area; the cantilever beam extending to the structural part, for defining three points of contact along the length of the cantilever beam, at the structural part, at the power side frame component and at the operating side frame component; the cantilever beam meeting both the operating side frame component and the power side frame component at respective points of contact, the cantilever beam being movable relative to each of the frame components at the respective point of contact;

an intermediate piece removably disposed between the operating side frame component and the base of the machine for supporting the operating side frame component, and the operating side frame component rests on the intermediate piece;

force applying means mounted on the operating side frame component for applying force to the cantilever beam for bending down the end of the cantilever beam at the operating side for lifting the operating side frame component off the intermediate piece, which permits removal of the intermediate piece; and an additional transverse beam spaced away from the cantilever beam for connecting the operating side frame component and the power side frame component.

23. A press section for a paper-making machine, wherein the press section includes press rollers for squeezing a felt, and felt guiding rollers for leading the felt over a pathway and past the press rollers;

a base of the machine for supporting the press section;

an operating side frame component located toward one of the ends of the press rollers; a power side frame component located toward the other of the ends of the press rollers and spaced from the operating side frame component;

a cantilever beam extending from the operating side frame component to the power side frame component and beyond the power side frame component to a support area;

a structural part connected to the base of the machine and located in the support area; the cantilever beam extending to the structural part, for defining three points of contact along the length of the cantilever beam, at the structural part, at the power side frame component and at the operating side frame component; the cantilever beam meeting both the operating side frame component and the power side frame component at respective points of contact, the cantilever beam being movable relative to each of the frame components at the respective point of contact;

an intermediate piece removably disposed between the operating side frame component and the base of the machine for supporting the operating side frame component, and the operating side frame component rests on the intermediate piece;

force applying means mounted on the structural part in the support area for applying force to the cantilever beam for bending down the end of the cantilever beam that is in the support area at the structural part for lifting the operating side frame component off the intermediate piece, which permits removal of the intermediate piece; and an additional transverse beam spaced away from the cantilever beam for connecting the operating side frame component and the power side frame component.

24. A press section for a paper-making machine, wherein the press section includes press rollers for squeezing a felt, and felt guiding rollers for leading the felt over a pathway and past the press rollers;

a base of the machine for supporting the press section;

an operating side frame component located toward one of the ends of the press rollers; a power side frame component located toward the other of the ends of the press rollers and spaced from the operating side frame component;

a cantilever beam extending from the operating side frame component to the power side frame component and beyond the power side frame component to a support area;

a structural part connected to the base of the machine and located in the support area; the cantilever beam extending to the structural part, for defining three points of contact along the length of the cantilever beam, at the structural part, at the power side frame component and at the operating side frame component; the cantilever beam meeting both the operating side frame components and the power side frame component at respective points of contact, the cantilever beam being movable relative to each of the frame components at the respective point of contact;

an intermediate piece removably disposed between the operating side frame component and the base of the machine for supporting the operating side frame component, and the operating side frame component rests on the intermediate piece;

force applying means mounted on the power side frame component for applying force to the cantilever beam for bending up the mid-section of the cantilever beam at the power side for lifting the operating side frame component off the intermediate piece, which permits removal of the intermediate piece; and an additional transverse bean spaced away from the cantilever beam for connecting the operating side frame component and the power side frame component.

* * * * *

UNITED STATES PATENT AND TRADEMARK OFFICE

CERTIFICATE OF CORRECTION

PATENT NO. : 4,560,441

DATED : Dec. 24, 1985

INVENTOR(S) : Kraft et al.

It is certified that error appears in the above-identified patent and that said Letters Patent is hereby corrected as shown below:

Title page:

At [30] Foreign Application Priority Data, please change the priority date to read as follows:

--October 31, 1979--.

Signed and Sealed this

*Twenty-ninth* Day of *July 1986*

[SEAL]

*Attest:*

DONALD J. QUIGG

*Attesting Officer*

*Commissioner of Patents and Trademarks*